US008887737B2

(12) United States Patent
Howell et al.

(10) Patent No.: US 8,887,737 B2
(45) Date of Patent: Nov. 18, 2014

(54) EXTRACTION AND STORAGE OF TOBACCO CONSTITUENTS

(75) Inventors: Tony M. Howell, Midlothian, VA (US); Gregory J. Griscik, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1618 days.

(21) Appl. No.: 11/192,446

(22) Filed: Jul. 29, 2005

(65) Prior Publication Data

US 2007/0023058 A1 Feb. 1, 2007

(51) Int. Cl.
*A24B 15/24* (2006.01)

(52) U.S. Cl.
CPC ..... *A24B 15/24* (2013.01); *A24B 15/243* (2013.01)
USPC ..... 131/297; 131/194; 131/298; 131/270; 131/310; 210/651; 210/787

(58) Field of Classification Search
None
See application file for complete search history.

(56) References Cited

U.S. PATENT DOCUMENTS

| | | | | |
|---|---|---|---|---|
| 678,362 | A | | 7/1901 | Froehling |
| 1,196,184 | A | | 8/1916 | Villiers-Stuart |
| 2,048,624 | A | | 7/1936 | Roselius |
| 2,128,043 | A | | 8/1938 | Garner |
| 2,227,863 | A | | 1/1941 | Rhodes |
| 3,096,773 | A | | 7/1963 | Neukomm et al. |
| 4,153,063 | A | | 5/1979 | Roselius et al. |
| 4,333,484 | A | | 6/1982 | Keritsis |
| 4,366,823 | A | | 1/1983 | Rainer et al. |
| 4,366,824 | A | | 1/1983 | Rainer et al. |
| 4,605,016 | A | | 8/1986 | Soga et al. |
| 4,898,673 | A | * | 2/1990 | Rice et al. ..... 210/634 |
| 4,956,052 | A | | 9/1990 | Hirata et al. |
| 4,986,286 | A | | 1/1991 | Roberts et al. |
| 5,018,540 | A | | 5/1991 | Grubbs et al. |
| 5,046,514 | A | | 9/1991 | Bolt |
| 5,060,669 | A | | 10/1991 | White et al. |
| 5,065,775 | A | | 11/1991 | Fagg |

(Continued)

FOREIGN PATENT DOCUMENTS

| | | |
|---|---|---|
| JP | 06-009986 | 1/1994 |
| JP | 07-227502 | 8/1995 |

OTHER PUBLICATIONS

International Search Report and Written Opinion dated Jul. 25, 2007 for PCT/IB2006/003816.

(Continued)

*Primary Examiner* — Richard Crispino
*Assistant Examiner* — Phu Nguyen
(74) *Attorney, Agent, or Firm* — Buchanan Ingersoll & Rooney PC

(57) ABSTRACT

A method of forming a liquor comprising tobacco solutes, the method comprising extracting tobacco solutes from tobacco by flowing an extraction solvent through tobacco to form a tobacco solutes-rich extraction solvent and a tobacco solutes-poor tobacco, and forming tobacco solutes-rich liquor by flowing the tobacco solutes-rich extraction solvent through an entrapment solvent, wherein the tobacco solutes comprise nicotine and at least one tobacco flavor compound and/or tobacco aroma compound and the liquor comprises the tobacco solutes dissolved in the entrapment solvent. A preferred extraction solvent comprises a supercritical fluid. Also provided are cigarettes and cigarette components comprising extracted tobacco solutes such as flavor compounds, aroma compounds and nicotine. Further, tobacco from which aroma compounds and/or nicotine have been extracted can be used in cigarettes.

22 Claims, 1 Drawing Sheet

(56) References Cited

U.S. PATENT DOCUMENTS

| | | | |
|---|---|---|---|
| 5,074,319 | A | 12/1991 | White et al. |
| 5,099,862 | A | 3/1992 | White et al. |
| 5,121,757 | A | 6/1992 | White et al. |
| 5,131,414 | A | 7/1992 | Fagg et al. |
| 5,138,075 | A | 8/1992 | Ohgaki et al. |
| 5,148,821 | A | 9/1992 | Best et al. |
| 5,197,494 | A | 3/1993 | Kramer |
| 5,234,008 | A | 8/1993 | Fagg |
| 5,235,992 | A | 8/1993 | Sensabaugh |
| 5,318,050 | A | 6/1994 | Gonzalez-Parra et al. |
| 5,360,022 | A | 11/1994 | Newton et al. |
| 5,435,325 | A | 7/1995 | Clapp et al. |
| 5,497,792 | A | 3/1996 | Prasad et al. |
| 5,593,792 | A | 1/1997 | Farrier et al. |
| 6,602,555 | B1 | 8/2003 | Von Fraunhofer |

OTHER PUBLICATIONS

Official Action issued Dec. 13, 2011 in corresponding Japanese Appln. No. 2008-523489.

* cited by examiner

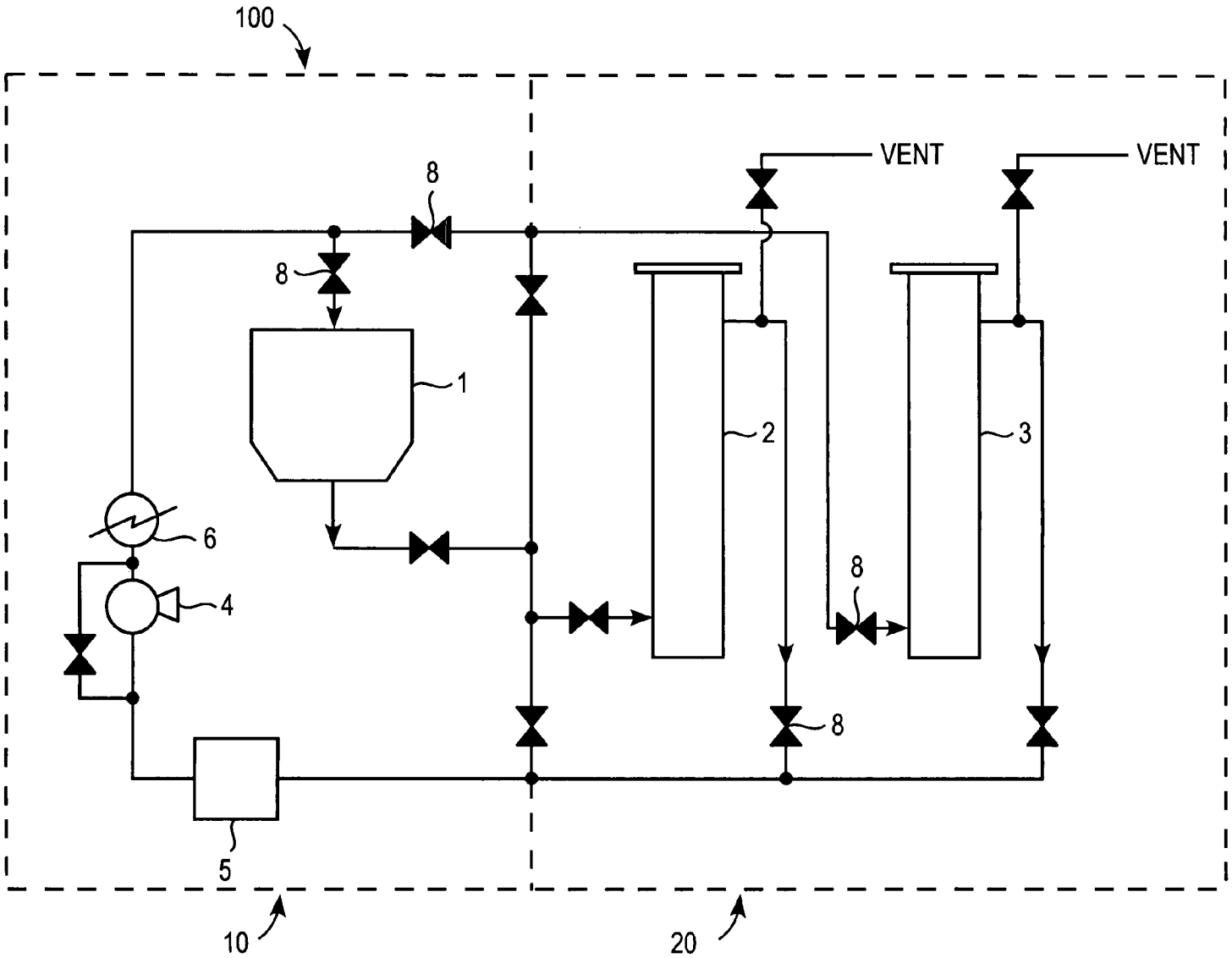
VENT
VENT
3
2
8
8
8
8
1
100
6
4
5
10
20

EXTRACTION AND STORAGE OF TOBACCO CONSTITUENTS

BACKGROUND

In the description that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art.

Nicotine extraction from tobacco using organic solvents has been disclosed by U.S. Pat. Nos. 3,096,773; 2,227,863; 2,128,043; 2,048,624; 1,196,184 and 678,362. Supercritical solvent extraction of nicotine from tobacco has been disclosed by U.S. Pat. No. 4,153,063 and commonly-owned U.S. Pat. Nos. 5,497,792 and 5,018,540.

Despite the developments to date, there is an interest in improved methods for extracting nicotine, flavor compounds and aroma compounds from tobacco. Furthermore, there is an interest in retaining the extracted nicotine and flavor/aroma compounds for subsequent tobacco processing and/or cigarette manufacture.

SUMMARY

A method of forming a tobacco solutes-rich liquor in an apparatus comprises i) extracting tobacco solutes from tobacco by flowing an extraction solvent through a first vessel containing tobacco to form a mixture of tobacco and tobacco solutes-containing extraction solvent, and ii) removing the tobacco solutes from the extraction solvent by flowing the tobacco solutes-containing extraction solvent through a second vessel containing an entrapment solvent, wherein the tobacco solutes comprise nicotine and at least one tobacco flavor/aroma compound and the entrapment solvent is selected from the group consisting of propylene glycol, triacetin, glycerin and mixtures thereof. The extraction solvent preferably comprises a supercritical fluid. The tobacco solutes-rich liquor comprises a solution of tobacco solutes dissolved in the entrapment solvent. The liquor can be in the form of a bulk liquid or the liquor can be encapsulated or formed into a microbead, fiber or film. After forming the tobacco solutes-rich liquor, the concentration of nicotine in the liquor can be reduced and/or the concentration of the at least one tobacco flavor compound or the at least one tobacco aroma compound in the liquor can be reduced.

Preferably nicotine and one or more tobacco flavor/aroma compounds are simultaneously extracted from the tobacco. In a preferred embodiment, at least 50% by weight or at least 80% by weight of the tobacco solutes in the tobacco are extracted from the tobacco.

The extraction of tobacco solutes from tobacco can comprise re-circulating the extraction solvent through the tobacco. For example, the ratio of the total mass of extraction solvent flowed through the tobacco to the mass of tobacco can be from about 75 to 500. Solutes can be extracted from substantially dry tobacco or from tobacco conditioned to have a moisture content up to about 30% by weight.

The extraction solvent can comprise supercritical carbon dioxide and can further comprise a co-solvent such as, for example, water; ethanol; methanol; acetone; propane; 2-propanol; chloroform; 1,1,1-trichloroethane; 2,2,2-trifluoroethanol; triethylamine; 1,2-dibromoethane and mixtures thereof.

A preferred entrapment solvent consists essentially of propylene glycol. A preferred ratio of the mass of entrapment solvent to the mass of tobacco from which tobacco solutes are extracted can be less than about 2, or more preferably less than about 1.

The tobacco solutes preferably are extracted from the tobacco and transferred to the entrapment solvent while the extraction solvent is maintained in a supercritical state. In order to improve the transfer efficiency of tobacco solutes from the extraction solvent to the entrapment solvent, the solutes-rich extraction solvent can be flowed through a vessel comprising a packing material in addition to the entrapment solvent. Furthermore, the transfer of tobacco solutes from the extraction solvent to the entrapment solvent can comprise re-circulating the solutes-laden extraction solvent through the entrapment solvent. In a preferred embodiment, the liquor comprises substantially all of the tobacco solutes extracted from the tobacco.

The step of extracting comprises flowing an extraction solvent through tobacco. The step of extracting can be repeated, wherein the extraction solvent is re-circulated through the same tobacco prior to removing the tobacco solutes from the extraction solvent. The step of removing comprises flowing tobacco solutes-containing extraction solvent through an entrapment solvent: The step of removing can be repeated, wherein the solutes-containing extraction solvent is re-circulated through a vessel containing entrapment solvent. However, in a preferred embodiment, the step of extracting and the step of removing are performed in a continuous flow arrangement (i.e., the extracting and the removing are occurring simultaneously in their respective vessels).

After the extracting and removing, the apparatus can be flushed by adding fresh extraction solvent to the apparatus, and simultaneously removing from the apparatus extraction solvent that was used to extract tobacco solutes from the tobacco. Preferably, the volume of the fresh extraction solvent added is substantially equal to the volume of the extraction solvent removed. During the steps of simultaneously adding fresh extraction solvent and removing used extraction solvent, the temperature and pressure within the first and second vessels preferably remain substantially constant. The volume of fresh extraction solvent added can be at least twice the total volume of the first and second vessels.

The tobacco solutes-rich liquor can be incorporated in a cigarette component such as tobacco cut filler, cigarette paper, cigarette filter, web or matt to form a flavor-modified cigarette component. A cigarette can comprise a flavor-modified cigarette component. Furthermore, in addition to cigarettes, the tobacco solutes-rich liquor can be used to flavor other tobacco-flavored products.

A method of making a cigarette comprises forming a tobacco solutes-rich liquor, spray-coating or dip-coating the liquor on tobacco cut filler and/or cigarette paper, providing the tobacco cut filler to a cigarette making machine to form a tobacco column, placing the cigarette paper around the tobacco column to form a tobacco rod of a cigarette, and optionally attaching a cigarette filter to the tobacco rod using tipping paper.

In a further embodiment, a flavor-modified tobacco cut filler comprises the tobacco solutes-poor tobacco made by extracting tobacco solutes from the tobacco. A cigarette can comprise a tobacco solutes-rich tobacco and/or a tobacco solutes-poor tobacco.

BRIEF DESCRIPTION OF THE DRAWINGS

FIG. 1 shows an apparatus for the extraction and solvent exchange of tobacco solutes from tobacco.

DETAILED DESCRIPTION OF PREFERRED EMBODIMENTS

Provided is an improved method of extracting tobacco constituents from tobacco and a method of producing a liquor comprising such extracted tobacco constituents. Also provided are cigarettes and components for cigarettes (e.g., cut filler, cigarette paper, cigarette filter, web or matt) comprising such extracted tobacco constituents. Further, the remainder portion of the tobacco from which such constituents have been extracted can be used in cigarettes.

Tobacco constituents such as flavor compounds, aroma compounds and/or nicotine are present in tobacco and are collectively referred to herein as "tobacco solutes." Tobacco solutes can be dissolved in an extraction solvent and removed from tobacco. The extraction solvent preferably comprises a supercritical fluid. Once removed from the tobacco, tobacco solutes dissolved in the extraction solvent can be partitioned from the extraction solvent to an entrapment solvent without the extraction solvent undergoing a phase change. A preferred entrapment solvent is propylene glycol, although other entrapment solvents such as, for example, triacetin, glycerin and mixtures thereof can be used. Once the tobacco solutes are partitioned from the extraction solvent to an entrapment solvent, the solutes-poor extraction solvent can be re-circulated to extract additional tobacco solutes (e.g., from fresh tobacco or the same tobacco). The solutes-laden entrapment solvent can be used in subsequent tobacco processing such as tobacco flavoring applications.

Preferably, flavor compounds, aroma compounds and nicotine are simultaneously extracted from tobacco using a supercritical fluid which can dissolve flavor compounds, aroma compounds and nicotine. A fluid is in a supercritical state when it is in the gas phase at a sufficiently high temperature that it cannot be liquefied by an increase in pressure. Supercritical fluids typically have densities similar to liquids but diffusivities and viscosities comparable to gases.

A preferred supercritical fluid is supercritical carbon dioxide (SCCO2). Supercritical carbon dioxide is carbon dioxide that is above its critical temperature, i.e., above about 31° C., and above its critical pressure, i.e., above about 70 atmospheres. Extraction with supercritical carbon dioxide is preferably carried out at a temperature ranging from above the critical temperature to about 120° C., and preferably at a pressure ranging from above the critical pressure to about 1500 atmospheres. In preferred embodiments, the temperature of supercritical carbon dioxide used to extract tobacco solutes is between about 60° C. and 100° C. (e.g., about 60, 70, 80, 90 or 100° C.±5° C.) and the pressure of supercritical carbon dioxide is between about 100 to 300 atmospheres (e.g., about 100, 150, 200, 250 or 300 atmospheres±25 atmospheres).

Other suitable extraction solvents that may be used in lieu of or in addition to carbon dioxide include n-propane, n-butane, n-pentane, n-hexane, n-heptane, n-cyclohexane, ethanol, n-pentanol, n-hexanol, toluene, acetone, methyl acetate, diethyl ether, petroleum ethers and halogenated hydrocarbons such as dichloromethane, difluoroethane, dichlorodifluoromethane, trifluoromethane and carbon tetrachloride. If desired, mixtures of supercritical fluids can be used.

The supercritical fluid(s) used as an extraction solvent may be any supercritical fluid that dissolves tobacco solutes under supercritical conditions. The temperature range and pressure range suitable for extraction using solvents other than carbon dioxide are typically on the same order of magnitude as those for carbon dioxide. The critical temperature ($T_c$) and critical pressure ($P_c$) of a supercritical fluid can be determined by routine experimentation or through reference materials such as the "CRC Handbook of Chemistry and Physics," 70th Edition, R.C. Weast et al., Editors, CRC Press, Inc., Boca Raton, Fla., 1989. The critical temperature and critical pressure for several fluids are listed in Table I.

TABLE I

Critical Temperatures and Critical Pressures for Several Fluids

| Fluid | $T_c$ (° C.) | $P_c$ (atm.) |
|---|---|---|
| carbon dioxide | 31 | 73 |
| n-propane | 97 | 42 |
| n-butane | 152 | 38 |
| n-pentane | 197 | 33 |
| n-hexane | 234 | 30 |
| n-heptane | 267 | 27 |
| cyclohexane | 280 | 40 |
| ethanol | 243 | 63 |
| toluene | 321 | 42 |
| acetone | 236 | 47 |
| methyl acetate | 234 | 46 |
| diethyl ether | 193 | 36 |
| dichloromethane | 237 | 60 |
| dichlorodifluoromethane | 112 | 41 |
| trifluoromethane | 26 | 47 |
| carbon tetrachloride | 283 | 45 |

Optionally, the tobacco can be modified to control the solubility of one or more tobacco solutes in the extraction solvent. For example, the solubility of tobacco solutes can be modified by controlling the pH of the tobacco via the addition of an acid (e.g., HCl) or a base (e.g., ammonia or aqueous ammonia) to the tobacco.

A supercritical fluid can further comprise a co-solvent such as, for example, water; ethanol; methanol; acetone; propane; 2-propanol; chloroform; 1,1,1-trichloroethane; 2,2,2-trifluoroethanol; triethylamine; 1,2-dibromoethane and mixtures thereof. A co-solvent can be used to increase or decrease the solubility of tobacco solutes in the supercritical fluid.

After extracting tobacco solutes from tobacco, the solutes-containing extraction solvent flows into an exchange system wherein the tobacco solutes are partitioned (i.e., transferred) from the extraction solvent to an entrapment solvent. The entrapment solvent preferably has limited solubility in the extraction solvent and a high affinity (e.g., adsorption or absorption affinity) for the tobacco solutes. Preferably the extracted tobacco solutes are partitioned from the extraction solvent to the entrapment solvent. In a preferred embodiment, substantially all the extracted tobacco solutes are partitioned to the entrapment solvent.

Before partitioning the tobacco solutes to the entrapment solvent, the concentration of nicotine in the extraction solvent can be reduced and/or the concentration of the tobacco flavor compound(s) or the tobacco aroma compound(s) in the extraction solvent can be reduced. After partitioning the tobacco solutes to the entrapment solvent, the concentration of nicotine in the entrapment solvent can be reduced and/or the concentration of the tobacco flavor compound(s) or the tobacco aroma compound(s) in the entrapment solvent can be reduced. A method for reducing the concentration of nicotine in an extraction solvent is disclosed in commonly-owned U.S. Pat. No. 5,497,792, the content of which is incorporated herein by reference in its entirety.

Any suitable vessel arrangement that is capable of maintaining supercritical conditions may be used to extract and transfer tobacco solutes. An apparatus suitable for the extraction from tobacco and subsequent solvent exchange of tobacco solutes is shown in FIG. 1. The extraction and exchange apparatus comprises an extraction sub-system in fluid communication with an exchange sub-system.

The apparatus 100 comprises a closed-loop flow system adapted to generate and circulate a supercritical fluid. The apparatus comprises an extraction sub-system 10 made up of a single extraction vessel 1 or a plurality of interconnected extraction vessels (not shown). For example, a plurality of extraction vessels can be connected in series or in parallel to form an extraction sub-system. Apparatus adapted to extract solutes from tobacco using a supercritical fluid are disclosed in commonly-owned U.S. Pat. Nos. 5,497,792 and 5,018,540, the contents of which are incorporated herein by reference in their entirety.

The apparatus 100 further comprises an exchange sub-system 20. The exchange sub-system can comprise a single exchange vessel or a plurality of interconnected exchange vessels 2,3. The one or more exchange vessels are in fluid communication with the one or more extraction vessels. In an exchange sub-system comprising a plurality of exchange vessels, the exchange vessels can be connected with each other in series or in parallel. In FIG. 1, exchange vessels 2,3 are shown connected in parallel and the outlet of each exchange vessel is shown optionally in fluid communication with open atmosphere (e.g., the outlets can flow to vent).

In operation, the extraction vessel 1 is loaded with tobacco, which forms a bed of tobacco within the vessel. Preferably, the extraction vessel is essentially filled with tobacco, although tobacco solutes can be extracted using an extraction vessel that is less than essentially filled with tobacco. A supercritical fluid can be circulated through the flow system via pump 4 and mass flow meter 5. Supercritical fluid can flow through one or more extraction vessels and one or more exchange vessels. The pressure of the supercritical fluid in the flow system is controlled by means of a fill pump (e.g., compressor) (not shown) and the temperature of the supercritical fluid is controlled by means of heat exchanger 6. A plurality of valves 8 can be used to control the flow of supercritical fluid through the apparatus.

Examples of suitable types of tobacco materials from which tobacco solutes can be extracted include flue cured, Bright, Burley, Maryland or Oriental tobaccos, the rare or specialty tobaccos, and blends thereof. The tobacco material can be provided in the form of tobacco lamina, processed tobacco materials such as volume-expanded or puffed tobacco, processed tobacco stems such as cut-rolled or cut-puffed stems, reconstituted tobacco materials, or blends thereof. Preferably, a single type of tobacco is processed during the extraction/partitioning processing steps.

The supercritical fluid is flowed through the extraction sub-system (i.e., through the tobacco) in order to extract tobacco solutes from the tobacco, and is flowed through the exchange sub-system (i.e., through entrapment solvent) in order to separate the extracted tobacco solutes from the supercritical fluid and partition them to the entrapment solvent. While the supercritical fluid can be flowed only through the extraction sub-system during solute extraction for a first processing time and only through the exchange sub-system during transfer of the solutes for a second processing time, in a more preferred embodiment the supercritical fluid can be simultaneously flowed (i.e., continuously flowed) through both extraction and exchange sub-systems. In such a preferred operation, the supercritical fluid flows in a continuous loop through the extraction and exchange sub-systems.

The supercritical fluid preferably enters the bottom of extraction vessel 1, passes upwardly through the tobacco bed, and exits at the top of the vessel. The extraction vessel 1 can be adapted for axial flow or radial flow of supercritical fluid through the tobacco. In axial flow, the supercritical fluid flows through the tobacco bed in a substantially vertical direction from the bottom of the extraction vessel toward the top of the extraction vessel. In radial flow, the supercritical fluid is directed to flow horizontally through the tobacco bed. For example, in a vessel designed for radial flow the supercritical fluid can enter at bottom of the vessel into a central, vertical cylindrically-shaped manifold. The supercritical fluid can flow out of the manifold in a substantially horizontal direction towards the periphery of the vessel through a plurality of orifices in the manifold. In addition to or in lieu of a central manifold, in a vessel designed for radial flow internal baffles can be used to direct horizontal flow of the supercritical fluid through the tobacco. A radial flow of supercritical fluid can minimize compaction of tobacco material and may allow for a lower pressure drop within the extraction vessel(s). In the case where multiple extraction vessels are used, the extraction vessels are preferably all designed for radial flow or all designed for axial flow of supercritical fluid. In passing through the tobacco bed, the supercritical fluid extracts tobacco solutes from the tobacco.

By circulating the supercritical fluid through the extraction vessel, the concentration of tobacco solutes in the supercritical fluid can be increased and the concentration of tobacco solutes in the remaining portion of the tobacco can be decreased. If the concentration of tobacco solutes in the supercritical fluid is less than the saturation limit for the tobacco solutes in the supercritical fluid, the supercritical fluid may become further enriched with tobacco solutes. One or more of the temperature, pressure and flow rate of the supercritical fluid through the extraction vessel can be controlled to control the solubility of tobacco solutes in the supercritical fluid. The geometry of the vessel (length, width or diameter and/or cross-sectional area) can be varied to control the solubility of tobacco solutes in the supercritical fluid.

A preferred total volume of supercritical fluid in the system is an amount that will maximize the concentration of tobacco solutes in the supercritical fluid that is flowed to the exchange sub-system.

As noted above, to extract tobacco solutes from the tobacco, the supercritical fluid is circulated and preferably re-circulated though the tobacco bed. While the mass of supercritical fluid in the extraction vessel can be from about 1 to 5 times, preferably from about 2 to 3 times the mass of the tobacco in the extraction vessel, the total mass of supercritical fluid circulated through the tobacco (i.e., via re-circulation) can be from about 75 to 500 times the mass of the tobacco. The ratio of the total mass of supercritical fluid circulated through the tobacco to the total tobacco mass (abbreviated "M/M") is more preferably between about 100 and 400 (e.g., about 100, 200, 300 or 400±50).

The supercritical fluid is circulated one or more times through one or more extraction vessels containing tobacco at a velocity sufficient to extract tobacco solutes. However, excessive supercritical fluid velocity can cause compaction of the tobacco bed and decrease the extraction efficiency of the system. While the extraction process removes tobacco solutes from the tobacco, preferably the circulation of supercritical fluid through the tobacco does not damage the tobacco. In a preferred embodiment, the supercritical fluid is introduced at the bottom of an extraction vessel containing tobacco and flowed upwardly through the bed of tobacco at a flow rate of from about 0.1 to 2 feet per minute, more preferably from about 0.5 to 1 feet per minute.

In addition to pumping the supercritical fluid at a desired velocity, the velocity can be controlled by choosing the dimensions of the extraction vessel. A proportionately greater vessel diameter, for example, can be used to decrease the solvent velocity for a given solvent throughput, while a smaller vessel diameter can be used to increase the volume of solvent contacting the tobacco per unit time. The height or length of the extraction vessel is preferably about 1 to 5 times, and more preferably about 1 to 2 times the width or diameter of the vessel.

Prior to extracting one or more tobacco solutes from tobacco, the tobacco can be pre-treated. For example, the extraction process can be carried out using dry or moistened tobacco. Tobacco can be conditioned to have a moisture content of up to about 30% (e.g., up to about 4, 8, 16 or 25%) or more of oven volatiles, where the percentage of oven volatiles in the tobacco is a measure of the moisture content plus a minor fraction of other volatile components. Furthermore, chemical bases such as ammonium bicarbonate can be used for pre-treating tobacco in order to affect the extraction efficiency of one or more tobacco solutes. Suitable chemical bases that can be used to pre-treat tobacco prior to solute extraction using a supercritical fluid are disclosed in commonly-owned U.S. Pat. No. 5,018,540, the content of which is hereby incorporated by reference in its entirety.

After circulating one or more times through the extraction vessel(s), the solutes-laden supercritical fluid is circulated through one or more exchange vessels 2,3. A series of valves can be used to direct the flow of supercritical fluid from the extraction sub-system to the exchange sub-system. Preferably, when the solutes-laden supercritical fluid is directed from the extraction sub-system to the exchange sub-system the supercritical fluid enters the bottom of an exchange vessel and passes upwardly exiting at the top.

A plurality of exchange vessels connected in series or in parallel may be used to remove tobacco solutes from a supercritical solvent in a process utilizing a single extraction vessel or a plurality of extraction vessels. Each exchange vessel contains an entrapment solvent that preferably has limited solubility in the supercritical fluid. Furthermore, the entrapment solvent preferably has a high adsorption or absorption affinity for the tobacco solutes. The exchange vessels are also preferably all designed for radial flow and/or axial flow of the supercritical fluid but need not be of the same design as the extraction vessels.

A preferred entrapment solvent is propylene glycol, though other entrapment solvents such as glycerin, triacetin or mixtures thereof may be used. Propylene glycol and glycerin, which are polyalcohols, and triacetin, which is a polyalcohol ester, are polar solvents and have limited solubility in water.

The supercritical fluid (e.g., supercritical carbon dioxide) is circulated through the exchange vessel(s) while under supercritical conditions. Therefore, the temperature and pressure inside the exchange vessel(s) are selected to maintain the supercritical fluid flowing from the extraction sub-system to the exchange sub-system in a supercritical state. Preferably, the temperature and pressure in the exchange vessel(s) are substantially equal to the temperature and pressure in the extraction vessel(s).

Because the extraction solvent is preferably maintained under supercritical conditions during both solute extraction and solute exchange, the method is more energy efficient than a method using a phase change of the supercritical fluid to effect solute exchange.

An entrapment solvent can absorb and/or adsorb tobacco solutes dissolved in the supercritical fluid. The absorptive and/or adsorptive efficiency of an entrapment solvent is typically inversely proportional to the concentration of solute in the entrapment solvent. Thus, when solutes-laden supercritical fluid is first introduced to an exchange vessel, the entrapment solvent has a large capacity for solute and can remove solute that is present in the supercritical fluid at low concentrations. As solute is partitioned to the entrapment solvent, the efficiency of solute transfer from supercritical fluid to entrapment solvent typically decreases.

The transfer efficiency of solute from supercritical fluid to entrapment solvent can be increased by 1) increasing the concentration of solute in the supercritical fluid, 2) decreasing the concentration of solute in the entrapment solvent, 3) changing the temperature, pressure and/or flow rate of the supercritical fluid, 4) incorporating a co-solvent in the supercritical fluid, and/or 5) changing the geometry of the extraction vessel.

Valves and other hardware can be configured to isolate and/or add extraction and exchange vessels to the system. For example, the apparatus can comprise valving and hardware adapted to remove from the system solutes-depleted tobacco, add to the system solutes-rich tobacco, add to the system solutes-free entrapment solvent and/or remove from the system solutes-enriched entrapment solvent. The addition and/or removal of a vessel is preferably performed while the vessel is isolated from the flow of supercritical solvent. Thus, the extraction and/or exchange processes are preferably not interrupted by adding or subtracting vessels from the system. Techniques for addition and removal of extraction and exchange vessels in a multi-vessel system is described in commonly-owned U.S. Pat. No. 5,497,792, the content of which is hereby incorporated by reference in its entirety.

In addition to providing valving to direct the flow of supercritical fluid through the extraction and exchange sub-systems, the flow system preferably comprises check valves, filters or other geometrical means to restrict the flow of entrapment solvent. The exchange vessel is preferably configured to retain the entrapment solvent in the exchange vessel while allowing supercritical fluid to flow through the exchange vessel. For example, supercritical fluid can flow into the exchange vessel through a one-way check valve that restricts back-flow of supercritical fluid and entrapment solvent out of the input to the exchange vessel. In a further example, the input piping that feeds into the exchange vessel can have a high-point above the exchange vessel, which can inhibit the back-flow of supercritical fluid and entrapment solvent out of the input to the exchange vessel.

The internal vessel geometry can be used to inhibit the flow of entrapment solvent from out of the top of the exchange vessel. In order to reduce entrainment of the entrapment solvent in the supercritical fluid, the axial flow rate of the supercritical fluid can be adjusted and/or an entrainment filter can be utilized. Thus, after the partitioning of solutes from the supercritical fluid to the entrapment solvent, the supercritical fluid, essentially depleted of solute and substantially free of entrapment solvent, can be returned to the extraction cycle by re-circulating it to the extraction vessel(s). Because typical entrapment solvents have a finite solubility in typical supercritical fluids, entrapment solvent that may be dissolved in the supercritical fluid can exit the exchange vessel and circulate through the system.

In the example where the entrapment solvent has a higher specific gravity than the supercritical fluid, the supercritical fluid preferably flows into the exchange vessel from the bottom and exits the exchange vessel from the top. When the entrapment solvent has a higher specific gravity than the supercritical fluid, the higher specific gravity can help retain the entrapment solvent in the exchange vessel. In the example where the entrapment solvent has a lower specific gravity than the supercritical fluid, the supercritical fluid preferably flows into the exchange vessel from the top and exits the exchange vessel from the bottom.

In a preferred embodiment, the supercritical fluid removes from the tobacco in the extraction system substantially all of the nicotine, flavor compounds and aroma compounds in the tobacco. In a further preferred embodiment, substantially all of tobacco solutes extracted by the supercritical fluid are partitioned from the supercritical fluid to the entrapment solvent.

In addition to the entrapment solvent, the exchange vessel(s) may contain inert filler or packing material that can improve the exchange efficiency of tobacco solutes from the supercritical fluid to the entrapment solvent. The packing material can be made of a metal such as stainless steel, titanium or Hastalloy; or ceramics such as aluminum oxide. Preferably, the packing material is highly porous (e.g., from about 90 to 99% porous by volume) in order to reduce the pressure drop inside the exchange vessel. The packing material can be wool, mesh, knit or other shape that can enhance the transfer of tobacco solutes from the supercritical fluid to the entrapment solvent when the solutes-laden supercritical fluid is flowed through the entrapment solvent.

The supply rate to the exchange vessel of solutes-laden supercritical fluid is preferably substantially equal to the discharge rate of solutes-free supercritical fluid from the exchange vessel.

In order to transfer substantially all of the tobacco solutes from the supercritical fluid to the entrapment solvent, the supercritical fluid can be re-circulated through one or more exchange vessels. As noted above, preferably solutes-free supercritical fluid is returned to the extraction sub-system to extract tobacco solutes after exiting the exchange sub-system.

When supercritical fluid is circulating through the extraction sub-system, preferably supercritical fluid is also circulating through the exchange sub-system.

The concentration of tobacco solutes in the supercritical fluid and/or entrapment solvent can be measured during or after the process (e.g., at the outlet of an extraction vessel and/or at the outlet of an exchange vessel) to determine the efficiency of the extraction and/or exchange.

The exchange vessel should contain a sufficient amount of entrapment solvent to trap essentially all of the tobacco solutes that are extracted from the tobacco. The ratio (kg/kg) of entrapment solvent to tobacco is preferably less than about 2, more preferably less than about 1 (e.g., 0.2, 0.4, 0.6 or 0.8±1). In a preferred embodiment, a supercritical fluid is used to extract from tobacco the majority of the tobacco solutes in the tobacco (e.g., greater than 50%, more preferably greater than 80% by weight).

After extracting from the tobacco a majority of the nicotine and/or a majority of the flavor and aroma compounds, the temperature and the pressure of the system can be returned to about room temperature and about atmospheric pressure, respectively, and the extracted tobacco and the solutes-laden entrapment solvent can be recovered from the system. However, because tobacco solutes and exchange solvents can have a finite solubility in most supercritical fluids, prior to reducing the temperature and/or the pressure of the system, a final exchange step can be used to substantially remove tobacco solutes and/or entrapment solvent from the supercritical fluid. A preferred final exchange step comprises releasing from the system the supercritical fluid used during the extraction while simultaneously adding fresh supercritical fluid into the system. The supercritical fluid being released from the system can be released into a final collection vessel. The fresh supercritical fluid is substantially solute free and extraction solvent free. During the final exchange, the system temperature and pressure preferably remain substantially constant. A volume of fresh supercritical fluid used in the final exchange (to flush the system) is preferably a volume effective to remove from the system substantially all of the supercritical fluid that was used in the extraction process. The volume of the fresh supercritical fluid used to flush the system can be at least twice the total volume of the system, more preferably at least four times the total volume of the system.

One benefit to a final exchange step (e.g., let down procedure) is that the tobacco within the system is exposed to (i.e., blanketed in) supercritical fluid that is substantially solute free and substantially extraction solvent free prior to depressurizing the system. By removing substantially all of the tobacco solute and substantially all of the exchange solvent from the supercritical fluid, the quality of the extracted tobacco can be improved. A further benefit to the final exchange step is that un-exchanged (i.e., residual) solute can be recovered from the supercritical fluid, which increases the overall efficiency of the system.

In a further preferred embodiment, provided is an entrapment solvent comprising tobacco solutes dissolved in the entrapment solvent. The solutes-laden entrapment solvent, which is preferably stored under refrigeration, can be used to incorporate one or more of the tobacco solutes in the preparation/modification of tobacco and/or in the manufacture of cigarettes.

The solutes-laden entrapment solvent can be incorporated into a component used to make a cigarette in an amount effective to modify the properties (e.g., organoleptic properties) of the cigarette component. Furthermore, by incorporating a solutes-modified cigarette component into a cigarette, it is possible to control the organoleptic properties of the cigarette. For example, tobacco solutes including flavor and aroma compounds can be extracted from Oriental tobacco and transferred to an entrapment solvent (e.g., propylene glycol) and later incorporated in a cigarette comprising Burley tobacco to impart Oriental tobacco overtones to the Burley tobacco cigarette.

According to an embodiment, the concentration of nicotine in the solutes-laden entrapment solvent can be reduced prior to incorporating the solutes-laden entrapment solvent into the manufacture of a cigarette or a cigarette component. The concentration of nicotine in the solutes-laden entrapment solvent can be reduced by at least 10, 20, 30, 40, 50, 60, 70, 80 or 90%. In a further embodiment, substantially all of the nicotine in the solutes-laden entrapment solvent can be removed (i.e., the concentration of nicotine in can be reduced by about 100%).

Any number of processes can be used to incorporate an entrapment solvent comprising tobacco solutes into a cigarette or a component of a cigarette (e.g., cut filler, cigarette filter, web, matt, or cigarette paper such as wrapping paper). For example, cigarette paper such as a cigarette paper wrapper can comprise a web of cellulosic material or a mat of fibers, fibrils or microfibrils.

A cigarette component can be spray-coated or dip-coated with a solutes-laden entrapment solvent. Micro-beads, particles, fibers or films of the solutes-laden entrapment solvent can be incorporated into a cigarette component such as tobacco cut filler. Furthermore, solutes-laden entrapment solvent can be incorporated into other tobacco flavored products.

The solutes-laden entrapment solvent may be added to cut filler tobacco stock that is supplied to a cigarette-making machine or incorporated in a pre-formed tobacco column prior to wrapping a cigarette wrapper around the tobacco column. The tobacco cut filler to which the solutes-laden entrapment solvent is added can comprise tobacco that has not been treated with an extraction solvent, or the tobacco cut filler can comprise the insoluble remainder of the tobacco after treating the tobacco with extraction solvent. According to one embodiment, a method for manufacturing a flavor-modified tobacco comprises the step of spraying tobacco (e.g., tobacco cut filler) with a solutes-laden entrapment solvent. The flavor-modified tobacco can optionally be dried and processed into a cigarette.

Another technique for incorporating extracted tobacco solutes in tobacco involves adding a solutes-laden entrapment solvent to a slurry of ingredients used to make reconstituted tobacco. The solutes-laden entrapment solvent, which preferably comprises nicotine and at least one flavor compound and/or at least one aroma compound, can be added to the slurry in any suitable amount. The slurry can be formed into reconstituted tobacco sheet and cut to size for incorporation as 100% filler of a tobacco rod or the cut strips can be added to tobacco rod filler material and the mixture formed into a tobacco rod.

Extracted tobacco solutes can be incorporated in and/or on cigarette paper to form a flavor-modified cigarette paper. A flavor-modified cigarette paper can be incorporated into a cigarette as wrapping paper or filler (e.g., shredded flavor-modified cigarette paper added to tobacco cut filler). By incorporating the tobacco solutes in the cigarette paper, the organoleptic properties of a cigarette comprising the flavor-modified paper can be controlled. A cigarette can comprise flavor-modified cigarette paper and/or flavor-modified tobacco cut filler. The tobacco cut filler used to form a cigarette can comprise 10, 20, 30, 40, 50, 60, 70, 80, 90% or more by weight of flavor-modified tobacco cut filler.

In a still further embodiment, provided is tobacco cut filler having a substantially reduced nicotine concentration and a substantially reduced concentration of both flavor compounds and aroma compounds. After processing in the extraction sub-system, the treated tobacco can have a reduced concentration of nicotine, flavor compound and/or aroma compound that is at least 50% less than, more preferably at least 80% less than untreated tobacco. Preferably, compared with un-extracted tobacco, the extracted tobacco is substantially free of nicotine, flavor compounds and aroma compounds.

The processed (e.g., extracted) tobacco can be incorporated into a cigarette. A method for making a cigarette comprises (i) extracting tobacco solutes such as nicotine, flavor compounds and aroma compounds from tobacco to form extracted tobacco; (ii) providing the extracted tobacco to a cigarette making machine to form a tobacco column; (iii) placing a cigarette wrapper around the tobacco column to form a tobacco rod of a cigarette; and (iv) optionally attaching a cigarette filter to the tobacco rod using tipping wrapper. The extracted tobacco is preferably used as filler in a cigarette further comprising un-extracted tobacco.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A method of forming a tobacco solutes-rich liquor in an apparatus, the method comprising:

i) extracting tobacco solutes from tobacco by contacting the tobacco with a supercritical extraction solvent while recirculating the supercritical extraction solvent through a first vessel containing tobacco to form a mixture of tobacco and tobacco solutes-containing supercritical extraction solvent, wherein the supercritical extraction solvent comprises a supercritical fluid, and ii) removing the tobacco solutes from the supercritical extraction solvent by contacting the solutes-containing supercritical extraction solvent with an entrapment solvent while recirculating the tobacco solutes-containing supercritical extraction solvent through a second vessel containing the entrapment solvent to form a tobacco solutes-rich liquor, wherein the supercritical fluid is maintained in a supercritical state during said recirculating and said i) extracting and ii) removing, and wherein the tobacco solutes comprise nicotine and at least one tobacco flavor compound and/or at least one tobacco aroma compound, nicotine and the at least one tobacco flavor compound and/or the at least one tobacco aroma compound are simultaneously extracted from the tobacco, and the entrapment solvent is selected from the group consisting of propylene glycol, triacetin, glycerin and mixtures thereof.

2. The method of claim 1, wherein at least 50% by weight or at least 80% by weight of the tobacco solutes in the tobacco are extracted from the tobacco.

3. The method of claim 1, wherein the supercritical fluid comprises carbon dioxide.

4. The method of claim 1, wherein the supercritical fluid further comprises a co-solvent selected from the group consisting of water; ethanol; methanol; acetone; propane; 2-propanol; chloroform; 1,1,1-trichloroethane; 2,2,2-trifluoroethanol; triethylamine; 1,2-dibromoethane and mixtures thereof.

5. The method of claim 1, wherein the moisture content of the tobacco during step i) is up to about 30% by weight.

6. The method of claim 1, further comprising treating the tobacco with an acid or a base prior to step i).

7. The method of claim 1, wherein the entrapment solvent consists essentially of propylene glycol.

8. The method of claim 1, wherein the ratio of the mass of entrapment solvent contained in the second vessel to the mass of tobacco contained in the first vessel is less than about 2 or less than about 1.

9. The method of claim 1, wherein the second vessel further contains a packing material that can improve the exchange efficiency of tobacco solutes from the extraction solvent to the entrapment solvent.

10. The method of claim 1, wherein the liquor comprises substantially all of the tobacco solutes extracted from the tobacco.

11. The method of claim 1, comprising alternately repeating steps i) and ii).

12. The method of claim 1, comprising repeating step i) and/or repeating step ii).

13. The method of claim 1, comprising simultaneously performing steps i) and ii).

14. The method of claim 1, further comprising reducing the concentration of nicotine and/or reducing the concentration of the at least one tobacco flavor compound and/or the at least one tobacco aroma compound in the solutes-rich liquor.

15. The method of claim 1, further comprising: adding fresh extraction solvent to the apparatus, and simultaneously removing from the apparatus extraction solvent used to extract tobacco solutes from the tobacco, wherein the volume of the fresh extraction solvent added is substantially equal to the volume of the extraction solvent removed.

16. The method of claim 15, wherein during the steps of simultaneously adding and removing, the temperature and pressure within the first and second vessels remain substantially constant.

17. The method of claim 15, wherein the volume of the fresh extraction solvent is at least twice the total volume of the first and second vessels.

18. A method of forming a tobacco solutes-rich liquor in an apparatus, the method comprising:

i) extracting tobacco solutes from tobacco by contacting the tobacco with a supercritical extraction solvent while recirculating the supercritical extraction solvent through a first vessel containing tobacco to form a mixture of tobacco and tobacco solutes-containing supercritical extraction solvent, wherein the supercritical extraction solvent comprises a supercritical fluid, wherein the ratio of the total mass of supercritical extraction solvent recirculated through the first vessel to the mass of tobacco contained in the first vessel is from about 75 to 500;

ii) removing the tobacco solutes from the supercritical extraction solvent by contacting the solutes-containing supercritical extraction solvent with an entrapment solvent while recirculating the tobacco solutes-containing supercritical extraction solvent through a second vessel containing the entrapment solvent to form a tobacco solutes-rich liquor; and wherein the supercritical fluid is maintained in a supercritical state during said recirculating and said i) extracting and ii) removing, and wherein the tobacco solutes comprise nicotine and at least one tobacco flavor compound and/or at least one tobacco aroma compound, nicotine and the at least one tobacco flavor compound and/or at least one tobacco aroma compound are simultaneously extracted from the tobacco, and the entrapment solvent is selected from the group consisting of propylene glycol, triacetin, glycerin and mixtures thereof.

19. A method of forming a tobacco solutes-rich liquor comprising tobacco solutes, the method comprising:

i) providing a supercritical extraction solvent having dissolved therein one or more tobacco solutes, wherein the extraction solvent comprises a supercritical fluid;

ii) removing the tobacco solutes from the supercritical extraction solvent by contacting the solutes-containing supercritical extraction solvent with a polar entrapment solvent while recirculating the tobacco solutes-containing supercritical extraction solvent through a vessel containing the polar entrapment solvent to form a tobacco solutes-rich liquor; and iii) removing a substantially tobacco solutes-free supercritical extraction solvent from the vessel, wherein the supercritical fluid is maintained in a supercritical state during said recirculating and said i) providing and ii) removing, and wherein the tobacco solutes comprise nicotine and at least one tobacco flavor compound and/or at least one tobacco aroma compound and nicotine and the at least one tobacco flavor compound and/or the at least one tobacco aroma compound are simultaneously extracted from the tobacco; and the polar entrapment solvent is selected from the group consisting of propylene glycol, triacetin, glycerin and mixtures thereof.

20. The method of claim 19, wherein the supercritical fluid comprises supercritical carbon dioxide.

21. The method of claim 19, further comprising reducing the concentration of nicotine and/or reducing the concentration of the at least one tobacco flavor compound and/or the at least one tobacco aroma compound in the solutes-rich liquor.

22. The method of claim 19, wherein the vessel further contains a packing material that can improve the exchange efficiency of removing tobacco solutes from the extraction solvent to the polar solvent.

* * * * *